United States Patent [19]

Barrus et al.

[11] 4,233,894

[45] Nov. 18, 1980

[54] PRINT HAMMER MECHANISM HAVING DUAL POLE PIECES

[75] Inventors: Gordon B. Barrus, El Segundo; Jerry Matula, Westminster, both of Calif.

[73] Assignee: Printronix, Inc., Irvine, Calif.

[21] Appl. No.: 911,989

[22] Filed: Jun. 2, 1978

[51] Int. Cl.[3] ..... B41J 7/70

[52] U.S. Cl. ..... 101/93.04; 400/124; 101/93.34; 101/93.09

[58] Field of Search ..... 101/93.04, 93.14, 93.09, 101/93.05, 93.29–93.34, 93.48; 400/124; 335/213, 236, 229, 250, 281, 282, 299

[56] References Cited

U.S. PATENT DOCUMENTS

| | | | |
|---|---|---|---|
| 3,049,990 | 8/1962 | Brown et al. | 101/93.34 |
| 3,673,955 | 7/1922 | Curtiss et al. | 101/93.34 X |
| 3,770,092 | 11/1973 | Grim | 400/124 |
| 3,804,009 | 4/1974 | Blume | 101/93.33 |
| 3,906,854 | 9/1975 | Gomi | 101/93.34 |
| 4,033,255 | 7/1977 | Kleist et al. | 107/93.04 |
| 4,044,668 | 8/1977 | Barrus et al. | 101/93.04 |
| 4,080,892 | 3/1978 | Imahashi | 101/93.09 X |
| 4,109,776 | 8/1978 | Elc et al. | 101/93.34 X |

*Primary Examiner*—Edward M. Coven
*Attorney, Agent, or Firm*—Fraser snd Bogucki

[57] ABSTRACT

A print hammer mechanism which forms a magnetic path between the opposite fixed and free ends of an elongated resilient hammer element using a permanent magnet, a first pole piece terminating in a pole tip adjacent the free end of the hammer element and electromagnetic means for cancelling the effects of the permanent magnet employs a second pole piece having a pole tip disposed adjacent the free end of the hammer element between the first pole piece and the fixed end of the hammer element. The relatively short magnetic path of low reluctance along the hammer element between the pole pieces combines with the effect of flux flowing in two gaps perpendicular to the flat surface of the hammer element to significantly improve the magnetic properties of the print hammer mechanism including the ability to quickly release and then retract the hammer element and the ability to increase the resonant frequency and/or the amount of energy stored in the hammer element for a given amount of magnetic flux available. The second pole piece forms a gap with the hammer element when the hammer element is in a spring-loaded retract position against the first pole piece, providing better retraction of the hammer after release and reducing the amount of magnetic energy required to overcome the effects of the permanent magnet and release the hammer element. The electromagnetic means for cancelling the effects of the permanent magnet consists of a coil wound about the first pole piece in direct contact therewith, enabling the first pole piece and adjacent parts of the magnetic circuit to provide adequate heat dissipating without the need for fins or other heat dissipating elements on the coil.

11 Claims, 8 Drawing Figures

FIG. 1
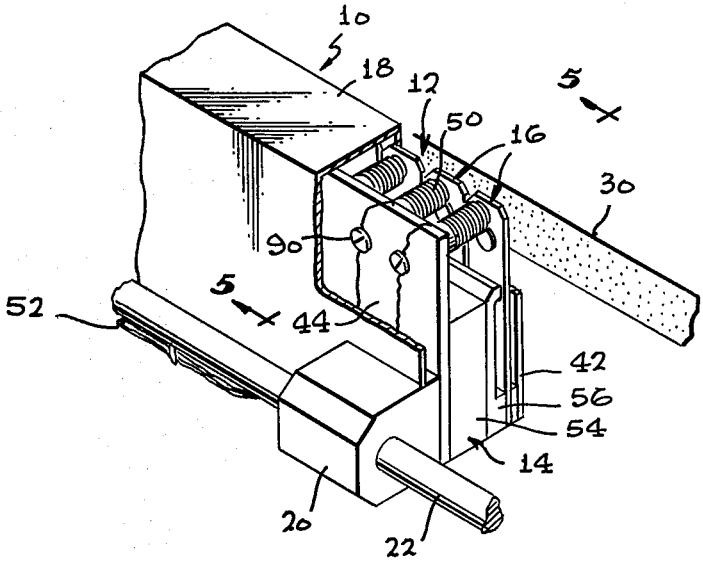
FIG. 2
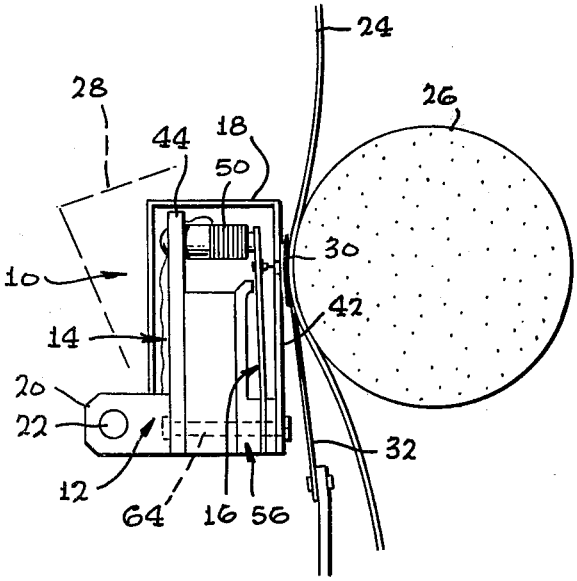
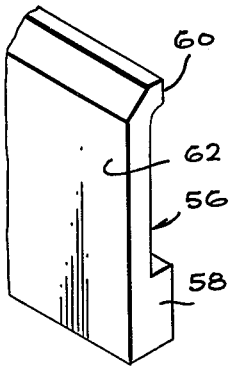
FIG. 3
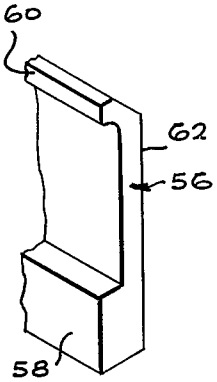
FIG. 4

FIG. 5
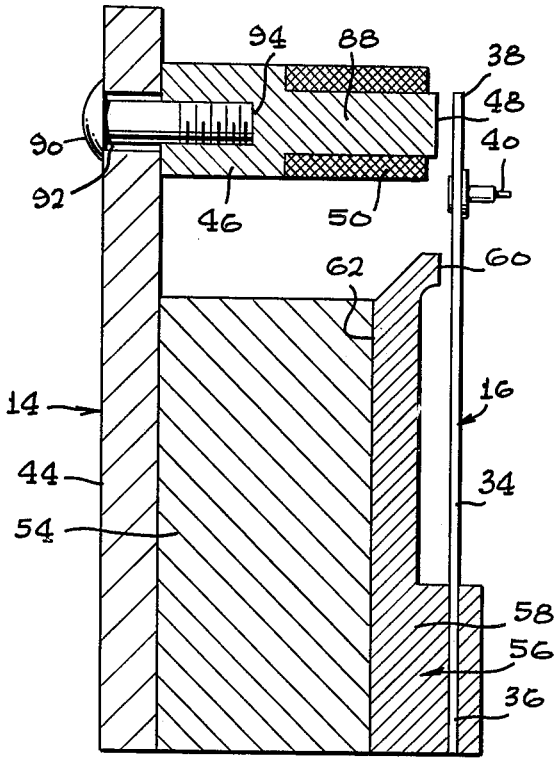
FIG. 6
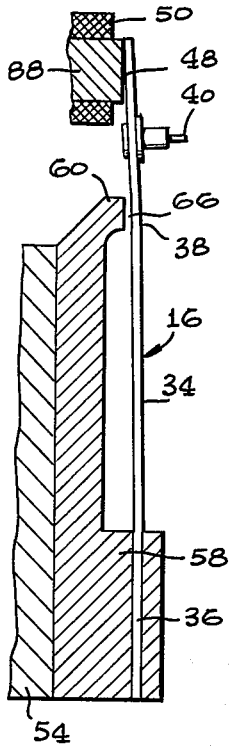
FIG. 7
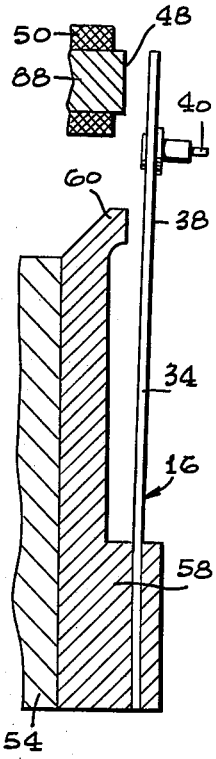
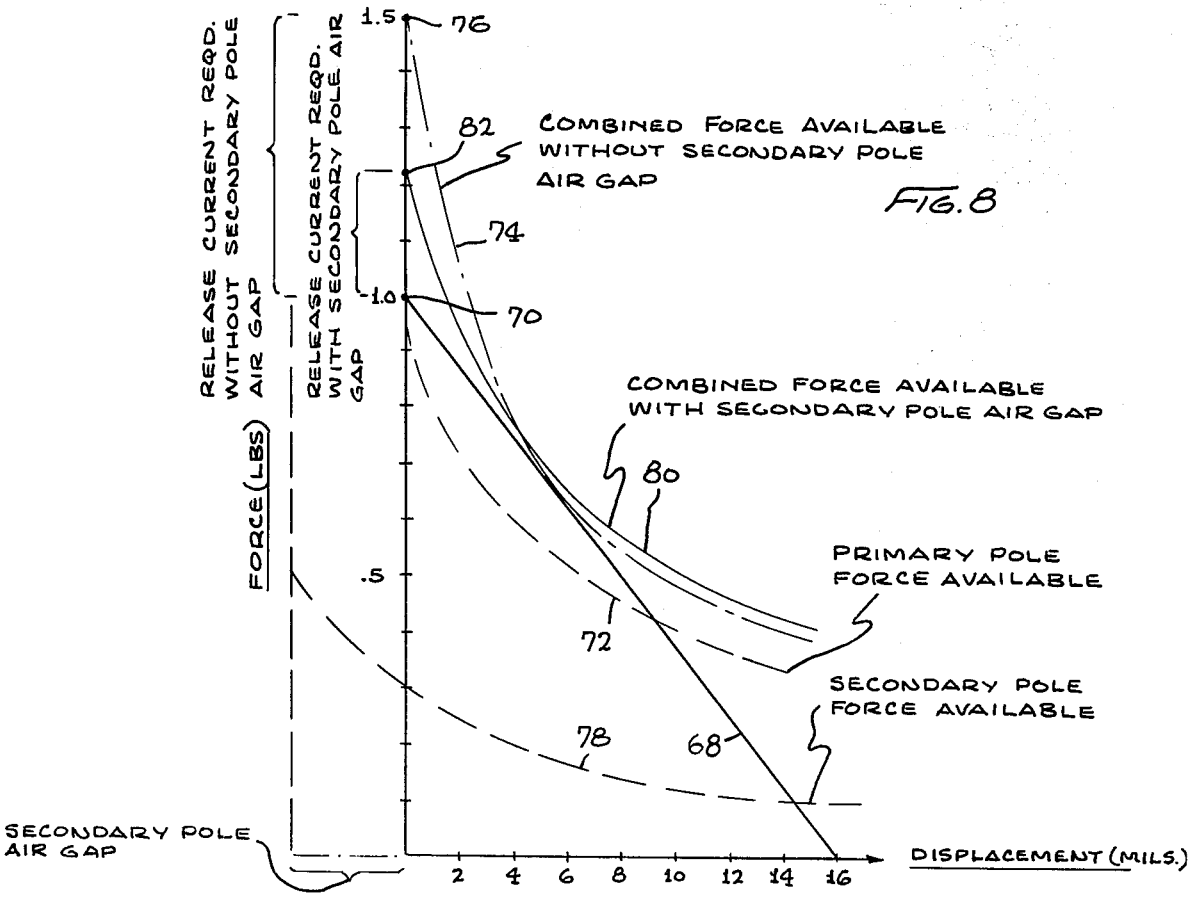
FIG. 8

PRINT HAMMER MECHANISM HAVING DUAL POLE PIECES

BACKGROUND OF THE INVENTION

1. Field of the Invention

The present invention relates to line printers, and more particularly to print hammer mechanisms for controlling the operation of a plurality of resilient elongated hammer elements mounted within a reciprocating hammer bank and having dot matrix impacting elements mounted thereon.

2. History of the Prior Art

It is known to provide in a dot matrix line printer a reciprocating shuttle containing a hammer bank in which a plurality of elongated, resilient, generally parallel hammer elements having dot impacting tips at the free ends thereof are selectively released from retracted positions so as to impact an ink ribbon against a platen supported print paper as the shuttle reciprocates relative to the print paper. Such an arrangement is shown in U.S. Pat. No. 3,941,051 of Barrus et al, issued Mar. 2, 1976 and commonly assigned with the present application. In the Barrus et al patent, the hammer bank employs a print hammer mechanism which forms a generally C-shaped magnetic circuit between the opposite fixed and free ends of the hammer elements. The magnetic circuits include a common permanent magnet to which the hammer elements are coupled at their fixed ends, a common magnetic return path coupled to the permanent magnet opposite the hammer elements and a plurality of pole pieces, each of which extends outwardly from the magnetic return path so as to terminate in a pole tip facing the free end of the hammer element. Flux from the permanent magnet normally pulls the hammer element out of a neutral position and into a spring-loaded retract position against the pole piece. Each time a coil surrounding the pole piece is momentarily energized, the attracting force of the permanent magnet is overcome long enough to release the hammer element from the retract position and send it flying in the direction of the ink ribbon and print paper. Following impacting of the dot printing tip against the ribbon and paper, the hammer element rebounds back into the spring-loaded retract position in preparation for the next energization of the coil.

The coils themselves are individually wound on bobbins with each bobbin surrounding a different pole piece. Each bobbin mounted coil must typically be provided with a finned heat dissipating element as shown, for example, in U.S. Pat. No. 4,033,255 of Kleist et al to provide adequate dissipation of heat generated by the coil.

The print hammer mechanism disclosed in Barrus et al U.S. Pat. No. 3,941,051 has been found to function effectively and efficiently for practically all applications of the line printer. However, there may be occasions where improvements in performance are desired. Such occasions may arise, for example, where space limitations within the line printer or within the hammer bank dictate a reduction in the width or thickness or both of the hammer elements. Such conditions may require an increase in the amount of magnetic energy, or conversely an increase in the efficiency of the magnetic circuit such that the magnetic flux available is more efficiently utilized. It is also desirable to avoid use of finned heat dissipating elements with the coils wherever possible.

Accordingly, it is an object of the invention to provide an improved print hammer mechanism.

It is a further object of the invention to provide an improved print hammer mechanism providing better hammer element release and retraction for a given amount of magnetic flux.

It is a still further object of the invention to provide an improved print hammer mechanism in which the resonant frequency of the hammer element can be increased for a given amount of magnetic flux.

It is a still further object of the invention to provide an improved print hammer mechanism the force-displacement characteristics of which can be varied so as to reduce the magnetic energy needed for hammer element release, to improve hammer element retraction and to enable other magnetic characteristics of the mechanism to be varied and generally improved upon.

It is a still further object of the invention to provide an improved print hammer mechanism in which adequate dissipation of heat from the coils is accomplished without finned heat dissipating elements or similar elements being mounted on the coils.

BRIEF DESCRIPTION OF THE INVENTION

These and other objects in accordance with the invention are accomplished by providing a print hammer mechanism having two different pole pieces in the magnetic circuit thereof. A first one of the pole pieces forming one leg in the magnetic circuit receives the hammer element when in the spring-loaded retract position. The second pole piece is disposed adjacent to but spaced apart from the first pole piece at the free end of the hammer element forming another path for flux in the magnetic circuit. Flux flowing between the first and second pole pieces via the hammer element flows through only a very small portion of the length of the hammer element, thereby greatly reducing the reluctance of this portion of the magnetic circuit and thereby improving magnetic properties and efficiency of the mechanism. In addition, the presence of two working air gaps in facing relation to the broad surface of the hammer element has been found to improve the hammer release and retract capabilities of the mechanism. Still further, the location of a portion of the magnetic circuit at the free end of the hammer element and therefore a substantial distance from the fixed end of the hammer element has been found to maximize the moment arm performance of the hammer element, again increasing the magnetic efficiency and performance of the mechanism.

In accordance with a feature of the invention the second pole piece is preferably disposed so as to provide a gap between the second pole piece and the hammer element when the hammer element is in the retract position. The presence of the air gap when the hammer element is in the retract position alters the force-displacement characteristics of the mechanism such that a smaller amount of magnetic energy is required to overcome the retract force of the permanent magnet to effect release. Moreover, the retraction of the hammer element following release has been found to occur more positively and quickly, again because of the altered force-displacement characteristics provided by the presence of the gap. A still further advantage arises from the fact that the reluctance of the gap is considerably greater than the reluctance of the small portion of the hammer element between the two pole pieces and is of fixed permeability, thereby compensating for variations in the magnetic properties of the hammer element.

By improving the magnetic properties of the print hammer mechanism, certain additional advantages ensue. The resonant frequency of the hammer element which is desirably made relatively high for optimum performance is closely linked with the spring constant of the hammer element which in turn requires greater flux as the dimensions or stiffness of the hammer element are varied to increase the resonant frequency. However, because of the presence of the two working air gaps in arrangements according to the invention, the hammer elements can be designed for greater resonant frequency without at the same time having to redesign an existing magnetic circuit so as to increase the magnetic energy thereof. By the same token, where space limitations or other factors such as a desire to locate a greater number of hammers within a given length of hammer bank dictate that the hammers be reduced in size, thereby making it more difficult to magnetically isolate the operation of each hammer from adjacent hammers in a bank configuration, increased magnetic properties provided by the invention enable the smaller hammer elements to operate positively and efficiently.

In one preferred arrangement of a print hammer mechanism according to the invention the fixed end of a hammer element is mounted on the outturned end of a relatively flat, generally planar secondary pole piece extending along a substantial portion of the length of the hammer element in generally parallel, spaced-apart relation and terminating in a pole tip facing the free end of the hammer element. The secondary pole piece abuts a permanent magnet mounted on the opposite side of which is the lower end of a magnetic return path element. A first pole piece of generally cylindrical configuration extends outwardly from an upper portion of the magnetic return path element, has an electromagnetic coil wound thereabout and terminates in a pole tip adjacent the free end of the magnetic element on the opposite side of the secondary pole piece from the fixed end of the magnetic element. The free end of the hammer element rests against the upper first pole piece when in the retract position and at the same time forms a gap with the lower secondary pole piece. The electromagnetic coil is wound directly onto the outer surface of the first pole piece to afford good thermal transfer therebetween. As a result a sufficient amount of heat from the coil is dissipated by the first pole piece and the adjoining magnetic return path element so as to avoid the need for finned heat dissipating elements on the coils.

BRIEF DESCRIPTION OF THE DRAWINGS

The foregoing and other objects, features and advantages of the invention will be apparent from the following more particular description of a preferred embodiment of the invention, as illustrated in the accompanying drawings, in which:

FIG. 1 is a perspective view, partly broken away, of a portion of a shuttle having therein a hammer bank employing print hammer mechanisms according to the invention;

FIG. 2 is an end view of the shuttle of FIG. 1 showing the shuttle with its included hammer bank disposed relative to print paper and a supporting platen;

FIG. 3 is a perspective view of the common hammer spring element mount and secondary pole piece used in the print hammer mechanism in the shuttle of FIGS. 1 and 2;

FIG. 4 is a different perspective view of the common hammer spring element mount and secondary pole piece shown in FIG. 3;

FIG. 5 is a sectional view of the hammer bank within the shuttle of FIG. 1 taken along the line 5—5 of FIG. 1 and showing the details of the first pole piece and its included coil;

FIG. 6 is a view of a portion of FIG. 5 with the hammer element in a spring-loaded, retract position;

FIG. 7 is a view of a portion of FIG. 5 showing the hammer element in its extreme released position; and FIG. 8 is a diagrammatic plot of force-displacement curves for the print hammer mechanism in the shuttle of FIGS. 1 and 2.

DETAILED DESCRIPTION

FIGS. 1 and 2 depict a shuttle 10 which includes a hammer bank 12 employing print hammer mechanisms 14 in accordance with the invention. Each of the print hammer mechanisms 14 which includes a different one of a plurality of hammers 16 advantageously employs two pole pieces as described in detail hereafter.

The shuttle 10 includes a hollow, generally rectangular cover 18 defining a frame for the shuttle. As seen in FIG. 1 a bracket 20 extends through the cover 18 to the outside of the shuttle 10 at one end thereof and receives a support shaft 22 therein. The opposite end of the shuttle 10 is also provided with a bracket and support shaft which are omitted from FIGS. 1 and 2 for simplicity of illustration but which function in the same manner as the bracket 20 and the support shaft 22 to permit sliding, reciprocating motion of the shuttle 10. At the same time the brackets permit the shuttle 10 to be pivoted outwardly and away from a length of paper 24 extending over a platen 26 as represented by a dotted outline 28 in FIG. 2.

The manner in which the shuttle 10 is mounted and driven in reciprocating fashion is identical to the arrangement described in previously referred to U.S. Pat. No. 3,940,051 of Barrus et al. The Barrus et al patent describes in considerable detail the manner in which a double lobed cam drive is used to reciprocate the shuttle relative to the paper to effect printing in dot matrix fashion by individual and independent actuation of a plurality of hammers mounted in parallel, side-by-side relation within the shuttle. Each hammer is equipped with a dot matrix printing tip substantially at the center of percussion thereof, which tip impacts an ink ribbon against the platen supported paper upon energization of a coil to release the hammer from a retract position in which it is normally held by a permanent magnet. Following each horizontal sweep of the shuttle along the paper to print a line of dots, the paper is vertically incremented and the shuttle thereafter undergoes a horizontal sweep in the opposite direction to effect printing of the next line of dots on the paper.

As seen in FIGS. 1 and 2 an ink ribbon 30 extends along the length of the shuttle 10 between the shuttle and the paper 24 and adjacent a spring finger 32 which acts to keep the paper 24 tightly drawn over the platen 26. As the individual hammers 16 are released the dot matrix printing tips mounted thereon impact the ribbon 30 against the paper 24 to effect printing of dots. The ribbon 30 is bidirectionally driven in the same manner as is the ribbon in the printer arrangement of the Barrus et al patent.

Each of the hammers 16 comprises an elongated, resilient, magnetic spring strip or element 34 mounted at a lower fixed end 36 thereof in spaced-apart relation to the other spring elements 36 along a generally horizontal axis and being generally vertically disposed and terminating in an upper movable free end 38 thereof. Each spring element 34 includes a dot matrix printing tip 40 extending normal from the surface of the element 34 in the direction toward the ribbon 30 and the paper 24. The tips 40 of the successive hammers 16 lie along a selected horizontal line substantially radial to the adjacent arc of the curved surface of the platen 26 and define the printing line position. When retracted, each tip 40 is disposed slightly behind a different aperture in a front face 42 of the cover 18 as best seen in FIG. 2.

As best seen in FIG. 5 the print hammer mechanisms 14 within the hammer bank 12 include a planar common return member 44 of magnetic material mounted in parallel, spaced-apart relation to the hammers 16 on the opposite sides of the hammers 16 from the printing tips 40. Each print hammer mechanism 14 includes a first pole piece 46 of generally cylindrical configuration having a pole tip 48 and extending outwardly from the common return member 44 into close juxtaposition to an associated one of the hammers 16. Each hammer 16 is in contact and in magnetic circuit with the adjacent magnetic pole piece 46 when in the retract position. Electromagnetic energizing coils 50 are individually wound around each of the pole pieces 46 adjacent the pole tip 48 thereof, with leads from the coils 50 conveniently being joined to terminals and printed circuit conductors (not shown in detail) on the common return member 44. External conductors to associated circuits are physically coupled together in a harness 52 extending outwardly from the shuttle 10 to associated driving circuits. The harness 52 reciprocates along its length with the motion of the shuttle 10.

The print hammer mechanisms 14 include a common permanent magnet 54 of elongated bar form, disposed between the common return member 44 and a common hammer spring element mount and secondary pole piece 56. The common spring element and secondary pole piece 56 serves as a common mount for each of the hammer spring elements 34 in addition to forming a second pole piece adjacent the hammer spring elements 34. The piece 56 is of thin, planar configuration and extends along a portion of the length of each hammer spring element 34 in generally parallel, spaced-apart relation thereto between an outwardly extending first end 58 and an opposite second end which terminates in a pole tip 60. The secondary pole piece 56 has a broad surface 62 on one side thereof disposed in contacting relation with the common permanent magnet 54. The first end 58 extends outwardly from a side of the pole piece 56 opposite the broad surface 62 so as to receive and mount the lower fixed ends 36 of the hammer spring elements 34 in generally parallel, spaced-apart relation therealong. The end of the pole piece 56 opposite the first end 58 curves outwardly on the opposite side thereof from the broad surface 62 to form the pole tip 60. As shown in FIG. 2 the sandwich consisting of the common return member 44, the common permanent magnet 54, the common hammer spring element mount and secondary pole piece 56, the hammer spring elements 34 and the front face 42 of the cover 18 is held together by a plurality of tie bars 64 spaced along the length of the elongated hammer bank 12.

Referring to FIG. 5 it will be seen that each print hammer mechanism 14 comprises a complete magnetic path which includes the common return member 44, the first pole piece 46, the hammer spring element 34, the common secondary pole piece 56 and the common permanent magnet 54. The common secondary pole piece 56, the common permanent magnet 54, the common return member 44 and the first pole piece 46 form a generally C-shaped magnetic circuit extending between the lower fixed end 36 and the movable upper free end 38 of the hammer spring element 34. The return member 44, the permanent magnet 54 and the secondary pole piece 56 all common to the entire hammer bank 12 and its included print hammer mechanisms 14, while the various first pole pieces 46 are individually associated with different ones of the hammer spring elements 34. The return member 44 and the permanent magnet 54 are both of elongated configuration so as to extend along the length of the hammer bank 12 with the permanent magnet 54 contacting the return member 44 along a lower portion of the return member. The various first pole pieces 46 are mounted in spaced-apart relation along an upper portion of the return member 44 so as to extend from the return member 44 into a location adjacent the free ends 38 of the various hammer spring elements 34. The various second pole pieces 56 are mounted in parallel, spaced-apart relation along a surface of the permanent magnet 54 opposite the return member 44 so as to mount the lower fixed ends 36 of the various hammer spring elements 34 in generally parallel, spaced-apart relation along the hammer bank 12.

As seen in FIG. 5 the pole tip 60 of the second pole piece 56 is disposed between the pole tip 48 of the first pole piece 46 and the lower fixed end 36 of the hammer spring element 34. At the same time, the pole tip 60 is disposed adjacent to and yet spaced-apart relative to the pole tip 48. Consequently, magnetic flux flowing between the first pole piece 46 and the hammer spring element 34 which would otherwise have to flow along substantially the entire length of the hammer spring element 34 to reach the permanent magnet 54 has an alternate path available as provided by the pole tip 60 and the second pole piece 56. Consequently, with the hammer spring element 34 in contact with or adjacent the pole tips 48 and 60 magnetic flux need only flow through the short portion of the length of the magnetic hammer element 34 between the pole tips 48 and 60, resulting in a low reluctance flux path between the pole tips 48 and 60. Consequently for a given amount of magnetic energy from either the permanent magnet 54 or the coil 50, the magnetic efficiency is increased.

During operation of the hammer bank 12 each of the individual hammers 16 is normally held in a spring-loaded retract position by the permanent magnet 54 which holds the movable free end 38 of the hammer spring element 34 in contact with the pole tip 48 of the first pole piece 46 as shown in FIG. 6. Release of the hammer from the retract position is accomplished by momentarily energizing the coil 50 to cancel the effects of the permanent magnet 54. When this happens the natural resiliency of the hammer spring element 34 causes the movable free upper end 38 to fly away from the first pole piece 46 to an opposite position shown in FIG. 7 in which the dot matrix printing tip 40 impacts the ribbon 30 against the platen supported paper 24. The combination of the impact and the resiliency of the hammer spring element 34 causes the hammer to return through a neutral position to the retract position of FIG. 6 in which the upper free end 38 of the hammer spring element 34 is again held in contact with the first pole piece 46 due to the permanent magnet 54.

The presence of the two different pole pieces 46 and 56 has been found to substantially improve the magnetic properties of the print hammer mechanism 14, not only because of an improved efficiency in the magnetic circuit due to the low reluctance path formed by the short portion of the hammer spring element 34 between the pole pieces 46 and 56 but also because of the effect of having two gaps facing and perpendicular to the adjacent broad surface of the hammer spring element 34. With the flux in the two gaps being directed generally normal to the adjacent surface of the hammer spring element 34, both release and retraction have been found to be significantly improved. This also relates to the fact that both of the gaps are a substantial distance from the hammer mount at the lower fixed end 36 thereof, thereby maximizing the moment arm performance of the pole pieces 46 and 56 relative to the hammer. Thus, although the lowered reluctance increases the flux, and the presence of the two gaps increases the retract force for a given amount of flux, less flux and the attractive force produced thereby are required to retract the hammer. Conversely, for a given amount of flux the presence of the two gaps adjacent the free end 38 of the hammer results in quicker and more positive retraction of the hammer.

Release of the hammer from the retract position is also improved by the presence of the two pole pieces and the associated air gaps. Again the presence of two gaps instead of one in which the flux is perpendicular to the adjacent broad surface of the hammer spring element provides a greater amount of deflecting force for faster release of the hammer from the retract position upon energization of the coil 50.

A further advantage of the print hammer mechanism 14 resides in the fact that for a given magnetic energy and material, the greater retract force provided by the second gap enables an increase in the stiffness of the hammer spring element which in turn increases the resonant frequency of the hammer. Thus:

$$f = 3.3 \times 10^4 \times \frac{t}{l^2} \tag{1}$$

where F is the resonant frequency of the hammer spring element, t is the spring element thickness and l is the spring element length. Therefore making the spring thicker (increasing t) increases f. However, increasing t increases the spring constant k, since:

$$k \propto \frac{wt^3}{l^3} \tag{2}$$

where w is the width of the spring element. The spring constant k partly determines kinetic energy and therefore:

$$KE = \frac{1}{2} Kx^2 \tag{3}$$

where KE is kinetic energy and x is displacement of the spring element. The release force required, $F_R$, is also partly determined by the spring constant k, and therefore:

$$F_R = \frac{kx}{2} \tag{4}$$

The release force available, $F_A$, is expressed by the equation:

$$F_A = \frac{\phi^2}{A} \tag{5}$$

where $\phi$ is the flux and A is the gap area. In the print hammer mechanism 14 the area A does not change but the force is greater because of the presence of a second working air gap. Thus for a two pole configuration the release force available, $F_A$, is expressed by the equation:

$$F_A = \frac{\phi 1^2}{A1} + K\frac{\phi 2^2}{A2} \tag{6}$$

where $\phi 1$ and $\phi 2$ are the fluxes in the first and second gaps, A1 and A2 are the areas of the first and second gaps, and K is a constant. Therefore the resonant frequency f can be made greater by increasing the thickness t for a given amount of magnetic energy, since the force is greater.

The print hammer mechanism 14 can be configured so that the movable upper free end 38 of the hammer spring element 34 contacts both the pole tip 60 of the second pole piece 56 and the pole tip 48 of the first pole piece 46 when in the retract position. In accordance with the invention, however, it is preferred to leave an air gap between the tip 60 of the second pole piece 56 and the movable upper free end 38 of the hammer spring element 34 when the hammer is in the retract position. Such a gap 66 is shown in FIG. 6. The advantage of the gap 66 can be understood by referring to FIG. 8 which depicts the force-displacement characteristics of the print hammer mechanism. Force is measured along the vertical axis and displacement of the hammer element is measured along the horizontal axis. The force of the hammer spring element 34 due to the natural resiliency thereof is represented by a line 68 in FIG. 8. It will be seen that the force exerted by the hammer is greatest under the condition of greatest flexure which occurs when in the retract position. When in the retract position, the hammer spring element 34 exerts a force represented by a point 70 in FIG. 8. A curve 72 represents the force available from the primary or first pole piece 46. In the absence of the gap 66 at the secondary pole piece 56, the force available as a result of the secondary pole piece combines with that from the first pole piece 46 represented by the curve 72 to produce a combined curve 74 which intersects the vertical axis at a point 76. The point 76 represents the force which must be overcome to release the hammer from the retract position. Therefore to effect release the coil 50 must provide a force at least equal to the difference between the forces at the points 70 and 76 so that the combined forces from the hammer spring element 34 and the coil 50 are at least equal to the opposing force from the permanent magnet 54.

Where the gap 66 is provided in the retract position, the practical effect is to shift the curve representing force available from the secondary pole piece 56 to the left as seen in FIG. 8 so as to produce a curve 78. The curve 78 combines with the curve 72 representing force available from the first or primary pole piece 46 to produce a combined curve 80 which intersects the vertical axis at a point 82. The resulting difference between the forces of the hammer spring element 34 and the dual pole pieces which are represented by the points 70 and 82 respectively is smaller, and therefore less energization of the coil 50 is required in order to release the hammer.

A further advantage of the air gap 66 when the hammer is in the retract position derives from the fact that the reluctance of the air gap 66 is a major one when compared with that of the hammer spring element 34. At the same time, the reluctance of the air gap 66 is of fixed permeability.

Referring again to FIG. 5 in conjunction with FIGS. 1 and 2, it will be seen that each pole piece 46 is of generally cylindrical configuration and has a base portion 86 of larger diameter adapted to be mounted on the common return member 44 and a front portion 88 for receiving the coil 50 and terminating in the pole tip 48. The coil 50 is wound onto the front portion 88 of the pole piece 46 in direct contact therewith. Consequently, heat from the coil 50 is quickly transferred to the pole piece 46 and the adjoining common return member 44 which acts as a heat sink to dissipate heat from the coil 50. As a result, adequate heat dissipation occurs without the need for finned radiators or other heat dissipating elements required to be mounted on the coil in arrangements where the coil is wound on a bobbin mounted on the pole piece. In the present instance the pole piece 46 and included coil 50 are mounted on the common return member 44 by a screw 90 extending through an aperture 92 in the member 44 from the back side thereof and engaging a threaded bore 94 within the base portion 86 of the pole piece 46. The screw 90 is easily removed where desired to effect removal of the pole piece 46 and the included coil 50.

While the invention has been particularly shown and described with reference to a preferred embodiment thereof, it will be understood by those skilled in the art that various changes in form and details may be made therein without departing from the spirit and scope of the invention.

What is claimed is:

1. A print hammer mechanism for a dot matrix printer comprising:

a magnetic resilient print hammer element comprising a single elongated, relatively flat strip of resilient material having a relatively small, uniform thickness between opposite broad surfaces and having a fixed end and an opposite free end and including a dot imprinting element extending from one of the broad surfaces of the elongated strip adjacent the free end thereof, the elongated strip being mounted at the fixed end thereof so as to assume a relatively straight configuration defining a neutral position when not flexed;

magnetic circuit means including permanent magnet means and a pair of pole pieces coupled in magnetic circuit with the elongated strip, the pair of pole pieces being disposed adjacent the free end of the elongated strip with one of the pair of pole pieces receiving the other one of the broad surfaces of the elongated strip and the other one of the pair of pole pieces forming an air gap with the other one of the broad surfaces of the elongated strip when the elongated strip is in a spring-loaded retract position in which the strip is flexed out of the neutral position and assumes a curved configuration, and the permanent magnet means establishing a magnetic field normally maintaining the elongated strip in the spring-loaded retract position; and means coupled to the one of the pair of pole pieces for substantially cancelling the magnetic field in a portion of the magnetic circuit means adjacent the elongated strip to release the elongated strip for flight away from the spring-loaded retract position, the resilient material of the elongated strip combining with the magnetic field of the permanent magnet means to return the strip to the spring-loaded retract position following release of the strip and impact of a printable medium by the dot imprinting element.

2. The invention set forth in claim 1, wherein the means for substantially cancelling comprises electromagnet means.

3. The invention set forth in claim 1, wherein the pair of pole pieces are spaced apart from each other along the length of the elongated strip by a distance which is a relatively small part of the length of the elongated strip.

4. A multiple hammer bank for a dot printer comprising:

a plurality of elongated, flat, substantially parallel, magnetic, spring hammer elements of relatively small, generally uniform thickness between a pair of opposite broad surfaces, the elements being of resilient material and being disposed in serial fashion along a selected axis in a selected plane and having free ends adjacent a printing line, each hammer including a dot printing element mounted on one of the opposite broad surfaces thereof and being mounted at an end thereof opposite the free end so as to assume a relatively straight configuration defining a neutral position when not flexed;

magnetic circuit means, including a common magnetic return path member, forming a plurality of substantially complete magnetic paths with said different hammer elements, said magnetic circuit means including a plurality of pairs of magnetic pole pieces, each pair of pole pieces being disposed in facing relation to the other one of the opposite broad surfaces at the free end of a different hammer element;

means coupled to said magnetic circuit means for magnetically biasing the other one of the opposite broad surfaces of each of said hammer elements into engagement with one of its associated pair of pole pieces and into an air gap forming relation with the other one of its associated pair of pole pieces in the absence of a release impulse, to define a spring-loaded retract position in which the hammer element is flexed out of the neutral position and assumes a curved configuration; and means coupled to the one of the pair of pole pieces of each of said magnetic circuit means for selectively applying release impulses thereto to momentarily overcome the magnetic bias and release the hammer element, the resilient material of the hammer element combining with the means for magnetically biasing to return the hammer element to the spring-loaded retract position following release of the hammer element and impact of a printable medium by the dot printing element mounted on the hammer element.

5. The invention set forth in claim 4, wherein the means coupled to each of said magnetic circuit means for selectively applying release impulses thereto comprises a plurality of coils, each of which is wound around and in direct contact with the one of each pair of pole pieces.

6. A multiple hammer bank for a dot printer comprising:

a plurality of elongated, flat, substantially parallel, magnetic, spring hammer elements disposed in serial fashion along a selected axis in a selected plane and having free ends adjacent a printing line, each hammer including a dot printing element;

magnetic circuit means, including a common magnetic return path member, forming a plurality of substantially complete magnetic paths with said different hammer elements, said magnetic circuit means including a plurality of pairs of magnetic pole pieces, each pair of pole pieces being disposed in facing relation to the free end of a different hammer element;

means coupled to said magnetic circuit means for magnetically biasing each of said hammer elements into engagement with at least one of its associated pair of pole pieces in the absence of a release impulse, to define a spring-loaded retract position; and means coupled to each of said magnetic circuit means for selectively applying release impulses thereto to momentarily overcome the magnetic bias;

the common magnetic return path member having opposite first and second portions thereof extending along the hammer bank and being generally parallel to the selected plane, the means for magnetically biasing said hammer elements comprising a common permanent magnet extending along the hammer bank and coupled to the first portion of the common magnetic return path member, a first one of each pair of magnetic pole pieces comprising an elongated element disposed substantially normal to said selected plane and having a first end coupled to the second portion of the common magnetic return path member and an opposite second end terminating in a pole tip disposed in facing relation to the free end of its associated hammer element, and a second one of each pair of magnetic pole pieces comprising a common, relatively flat, generally planar element disposed substantially parallel to said selected plane and having a first end disposed between and coupling a fixed end of its associated hammer element opposite the free end thereof to the common permanent magnet and an opposite second end terminating in a pole tip disposed in facing relation to the free end of its associated hammer element between the first one of the pole pieces and the fixed end of its associated hammer element.

7. A print hammer mechanism comprising:

an elongated, flat, resilient hammer element having opposite fixed and free ends and a printing element mounted thereon adjacent the free end thereof;

a first elongated pole piece having a first end and terminating in a pole tip opposite the first end thereof which is disposed in facing relation to the free end of the hammer element;

a second elongated pole piece having a first end coupled to the fixed end of the hammer element and extending along a substantial portion of the length of the hammer element in spaced-apart relation thereto and terminating in a pole tip opposite the first end thereof which is disposed in facing relation to the free end of the hammer element, the pole tip of the second elongated pole piece being disposed between the pole tip of the first elongated pole piece and the fixed end of the hammer element;

a permanent magnet coupled to the second elongated pole piece opposite the hammer element;

a magnetic return path member having a first end thereof coupled to the permanent magnet opposite the second elongated pole piece and an opposite second end coupled to the first end of the first pole piece; and an electromagnetic coil disposed about the first elongated pole piece.

8. The invention set forth in claim 7, wherein the permanent magnet is operative to hold the hammer element in a flexed, spring-loaded retract position against the pole tip of the first elongated pole piece in the absence of energization of the electromagnetic coil, and the hammer element forms a small gap with the pole tip of the second elongated pole piece when in the spring-loaded retract position.

9. The invention set forth in claim 7, wherein the second elongated pole piece is of flat, planar configuration and has a broad surface thereof abutting the permanent magnet, a raised portion at the first end thereof extending outwardly in a given direction opposite the broad surface and into contact with the fixed end of the hammer element and a raised portion at the end thereof opposite the first end extending outwardly in the given direction opposite the broad surface and terminating in the pole tip, the permanent magnet is of generally rectangular configuration, the return path member is of flat, planar configuration and is disposed generally parallel to the second elongated pole piece and the hammer element, and the first elongated pole piece is of generally cylindrical configuration and extends in a direction generally normal to the plane of the magnetic return path.

10. The invention set forth in claim 7, wherein the first elongated pole piece has a front portion between the first end and the pole tip which is stepped down in size relative to the first end and which has the electromagnetic coil wound thereon in direct contact therewith.

11. The invention set forth in claim 10, wherein the first end of the first elongated pole piece is mounted on the second end of the magnetic return path member by a screw extending through an aperture in the second end of the magnetic return path member and into the first end of the first elongated pole piece.

* * * * *